US009725854B2

(12) United States Patent
Duong et al.

(10) Patent No.: US 9,725,854 B2
(45) Date of Patent: Aug. 8, 2017

(54) RAILWAY AIL FASTENING ASSEMBLY AND METHOD

(71) Applicant: PANDROL LIMITED, Addlestone, Surrey (GB)

(72) Inventors: Pelle Nghi Duong, Garnet Valey, PA (US); Jonas Ottosson, Gothenburg (SE)

(73) Assignee: Pandrol Limited, Surrey (GB)

( * ) Notice: Subject to any disclaimer, the term of this patent is extended or adjusted under 35 U.S.C. 154(b) by 165 days.

(21) Appl. No.: 14/751,234

(22) Filed: Jun. 26, 2015

(65) Prior Publication Data

US 2016/0376751 A1 Dec. 29, 2016

(51) Int. Cl.

| | |
|---|---|
| ***E01B 9/60*** | (2006.01) |
| ***E01B 3/28*** | (2006.01) |
| ***E01B 9/68*** | (2006.01) |

(52) U.S. Cl.

CPC ..... *E01B 9/60* (2013.01); *E01B 3/28* (2013.01); *E01B 9/68* (2013.01)

(58) Field of Classification Search

CPC . E01B 9/303; E01B 9/30; E01B 9/306; E01B 9/483; E01B 2205/00; E01B 9/68; E01B 9/34; E01B 9/48; E01B 3/28; E01B 9/60

USPC ..... 238/351, 349

See application file for complete search history.

(56) References Cited

U.S. PATENT DOCUMENTS

| | | | | |
|---|---|---|---|---|
| 3,460,756 A * | 8/1969 | Sanson | ..... | E01B 9/30 238/283 |
| 6,367,704 B1 | 4/2002 | Mediavilla | | |
| 7,669,779 B2 | 3/2010 | Young | | |
| 7,690,584 B2 * | 4/2010 | Geissele | ..... | E01B 9/303 238/264 |
| 2008/0203181 A1 * | 8/2008 | Young | ..... | E01B 9/303 238/351 |

* cited by examiner

*Primary Examiner* — Mark Le

(74) *Attorney, Agent, or Firm* — Gottlieb, Rackman & Reisman, PC

(57) ABSTRACT

A fastening system or apparatus for securing a rail to the underlying railroad tie includes a pad, two insulators attached to the pads and two shoulders attached to the ties. An interference fit is formed between the insulators and the shoulders to capture the pad between the shoulders. The insulators are pre-attached to the pad. The mating protrusions of the shoulders and pad allows for ease of insertion such that the pad assembly can be shipped together with the underlying tie.

12 Claims, 6 Drawing Sheets

RAILWAY AIL FASTENING ASSEMBLY AND METHOD

RELATED APPLICATIONS

None

BACKGROUND OF THE INVENTION

A. Field of Invention

This invention pertains to a rail support assembly for supporting the rails of a railroad track. The assembly includes shoulders preferably attached or mounted on a precast concrete tie and a pad disposed on top of the tie and captured between the shoulders so that the whole assembly can be stored and shipped to a track installation/repair site as a single unit.

B. Background of the Invention

Generally speaking, the present invention pertains to the art of securing the rails forming railroad tracks to transversal ties. Typically, a rail support assembly is used that includes a pair of shoulders, somewhat flexible clips engaging the shoulders and shaped to secure the lateral flange of the rail to the tie and a generally electrically insulating pad. The pad is positioned between the two shoulders and under the rail. The elements of rail support assembly are often tied together and shipped to the installation site. For some types of railroads, for example light rails, the shoulders are imbedded into the ties as they are being cast, for example, from concrete and thus are not transported to the site together with the rest of the elements of the support assembly. As a result, the rest of the assembly or some parts thereof, can easily separate, get lost, or stolen. Thus, shipping and installing these support assembly create a logistic and economic nightmare.

It has been suggested by some references (see for instances, U.S. Pat. Nos. 6,367,704 and 7,669,779) that the assembles be provided that used captive elements. The assemblies are attached to the shoulders together with the clips to the ties prior to their shipping. However, the previously suggested concepts were only useable with split clips and not with convoluted or S-shaped clips that are now used almost universally. Moreover, the suggested solutions required elements with complex shaped that are difficult and expensive to make; required a complex installation requiring the use of a heavy hammer; and required the rail clip to be part of the assemblies to hold the rail pad in place.

SUMMARY OF THE INVENTION

According to the present invention there is provided a railway rail fastening assembly for fastening a railway rail to an underlying rail foundation (e.g., a cast concrete tie). The assembly includes two railway shoulders. Each shoulder is formed with a protrusion on the rail facing. A pad is sized and shaped with or attached to two lateral insulators. The insulators have lateral sides for mating with the posted pad assembly; the pad assembly comprising of either a single or composite pad and insulator; where the insulators face the shoulders and having protrusions or ribs mating with groves on the shoulders to retain pad in a captive position. The protrusions on the insulators also serve as seals or covers against dirt and debris—runoff in between insulator and/or pad and shoulder and/or rail seat. Additionally, the insulator protrusions are angled to guide the rail into the rail seat area aiding the process of placing the rail into the rail seat, further having the posted pad assembly allows the dunnage to be reduced by an amount equal to the pad thickness plus the compression amount of the pad due to external forces to the system such as crosstie stack height, storage temperature, etc.; the pad assembly is being held captive in the assembly against unintentional removal from the rail seat whereby the pad is pre-attached to the side post insulators located in a mirror image of each other with the pad in the middle, and the pad is of preferably of a softer material to attenuate rail seat loads and the insulators in a stiffer material to resist rail seat lateral loads and together the pre-attached, insulators and pad, represents the posted pad assembly of which they together electrically insulates the rail from the underlying foundation, the said insulators are pre-attached to the pad, preferably overmolded, as an assembly of which can be hand-inserted or utilizing a 0.5" or higher gravity drop of posted pad assembly into the rail seat. The gravity drop requires the posted pad assembly to be centered above the rail seat to within a 0.25". The mating protrusions of the shoulders and posted pad allows for ease of insertion and so that the posted pad assembly can be shipped together with the underlying foundation. The preferred method to remove the posted pad assembly, from inserted and captive position, is to compress the pad slightly, preferably, against either of the two shoulders in order to vertically disengage the shoulder and insulator protrusions from each other; the rail clip, preferably with a pre-attached electrically insulating plastic toes installs into the shoulders, after rail has been put in the rail seat, to fasten the rail on the pad and in between the two insulators whereby the clip bears against the base of the rail and anchored to the shoulders that are secured by embedment into underlying foundation; a clip is not required to retain the pad assembly in pre-assembly position. The clip used with the assembly preferably has a plastic toe pre-attached electrically insulating the clip from the rail.

DETAILED DESCRIPTION OF THE INVENTION

Figure 1:
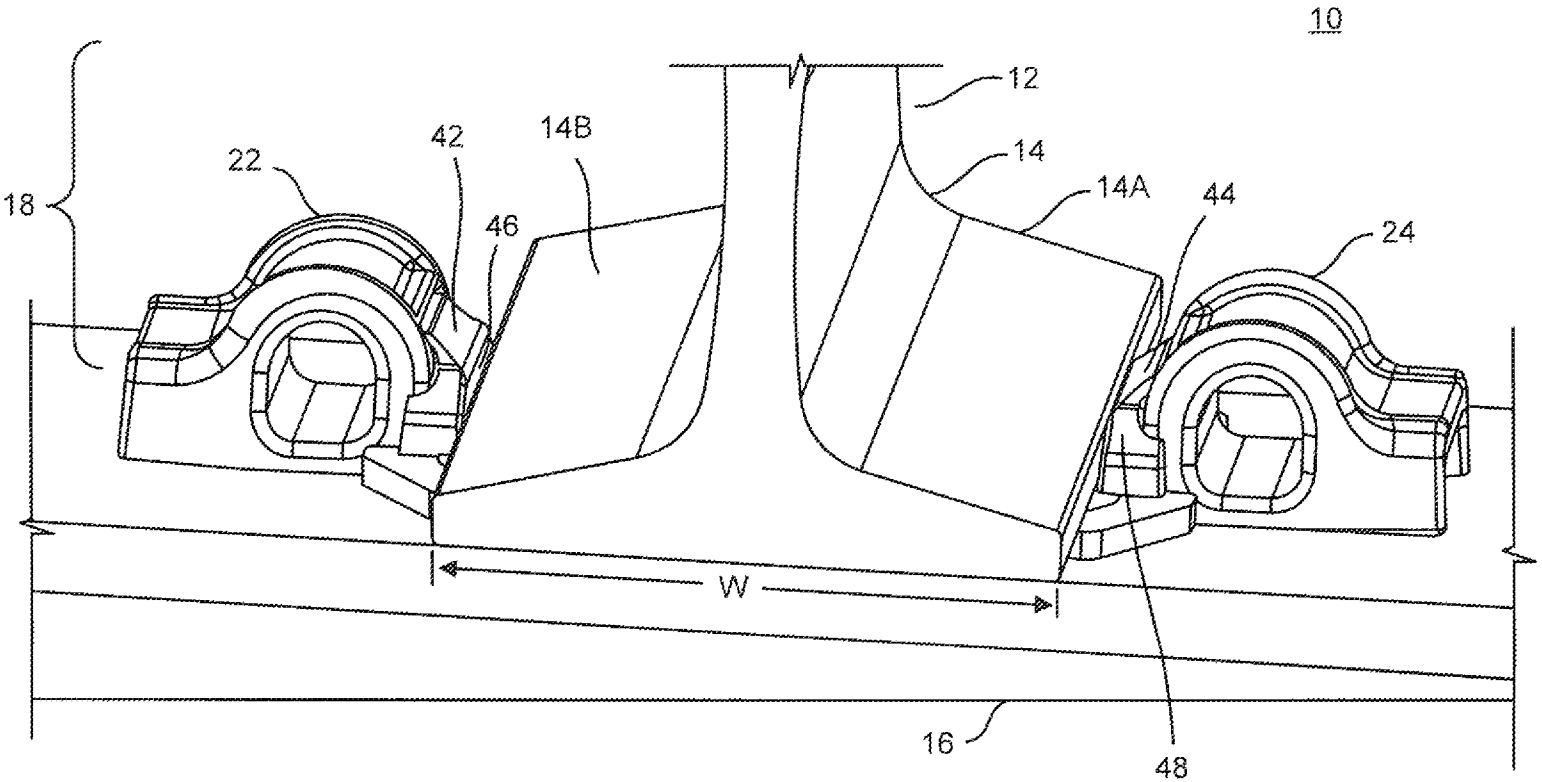
FIG. 1 shows a side view of a rail fastened to a tie in accordance with this invention.
Figure 2A:
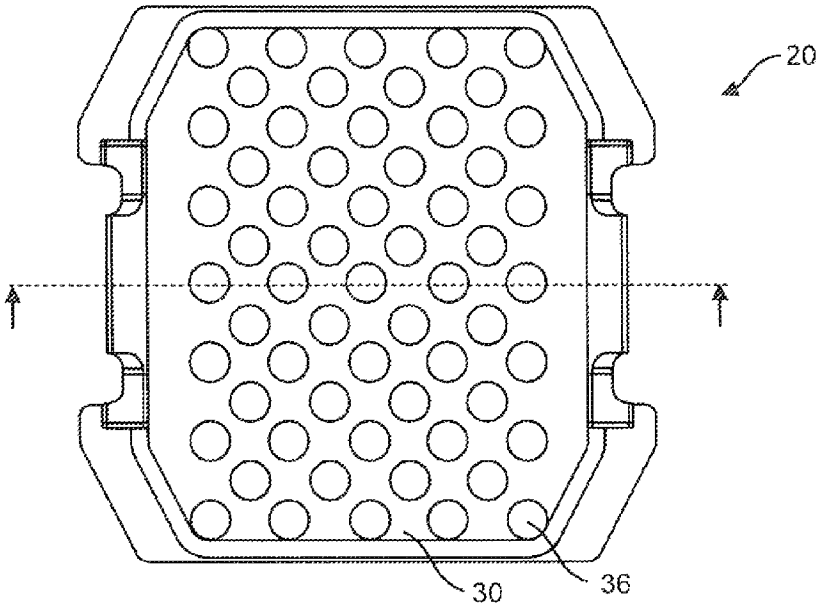
FIG. 2A shows a plan view of a pad used supporting the rail in FIG. 1.
Figure 2B:
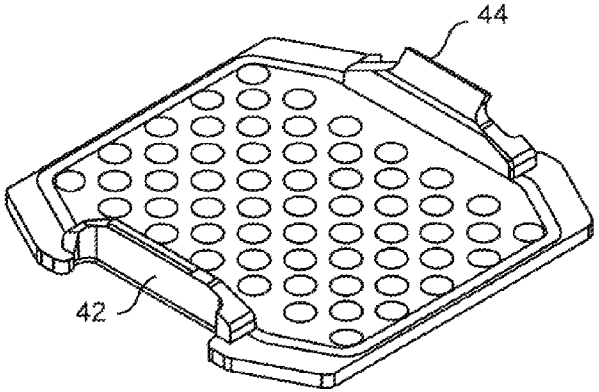
FIG. 2B shows an orthogonal view of the pad of FIG. 2A.
Figure 2C:
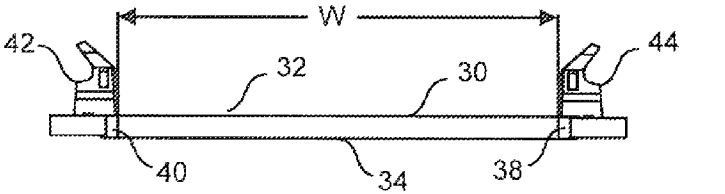
FIG. 2C shows a side view of the pad of FIG. 2A.
Figure 2D:
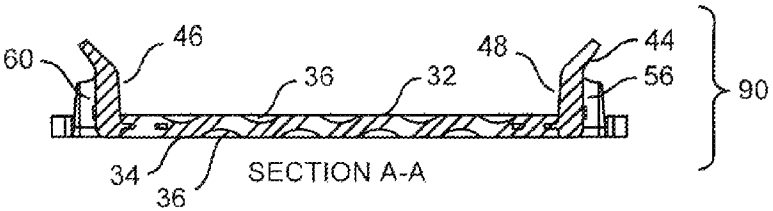
FIG. 2D shows a side sectional view of the pad of FIG. 2A taken along lines A-A.

Referring now to FIG. 1 a railroad assembly 10 constructed in accordance with this invention includes a rail 12 having a foot 14 with two sections 14A, 14B. The rail 12 is supported on a tie 16 by a fastening assembly 18.

Fastening assembly 18 includes a pad 20, and two shoulders 22, 24. The two shoulders 22, 24 are imbedded in a conventional concrete tie 25. The rail 12 is secured to the fastening assembly 18 by two conventional clips, such as e-clips available from Pandrol. These clips have been omitted from the figures for the sake of clarity.

As shown in FIGS. 2A-2D, the pad 20 includes a generally rectangular central portion 30 with a top surface 32 and a bottom surface 34. Both surfaces 32, 34 are formed with a plurality of circular indentations 36 as shown. The central portion includes two longitudinal sides 38, 40. These sides are sized and shaped to mate with two insulators 42, 44. In one embodiment, the insulators 42, 44 are made separately and joined to the central portion 30 by an interference fit and/or by an adhesive. In one embodiment, the two insulators 42 and 44 and the central portion 30 are a single piece made by molding or other well known-techniques.

The central portion 30 and insulators 38, 40 are sized and shaped to insure that two vertical inner surfaces 46, 48 of the insulators are oriented perpendicularly to the top surface 32 and in parallel to each other and are separated by a distance W. W is also width of the foot 14 so that when the rail 12 is placed on the pad 20 it fits snugly between walls 46, 48, as shown in FIG. 1.

Figure 3B:
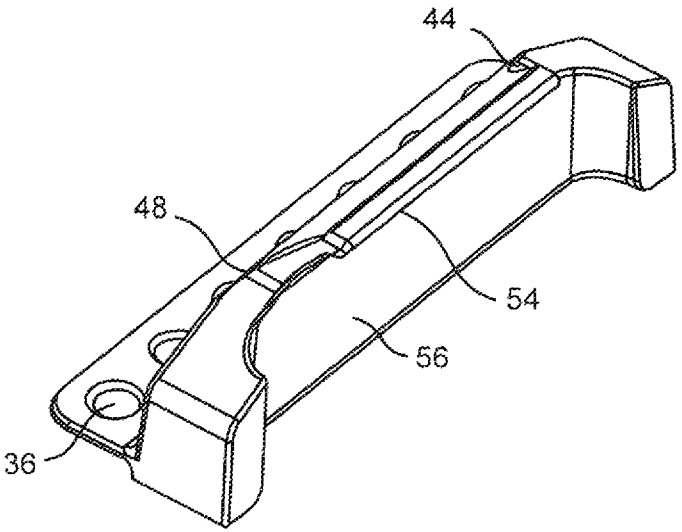
FIGS. 3A and 3B show isometric views of the insulators attached to the pad of FIGS. 2A-2D.
Figure 3A:
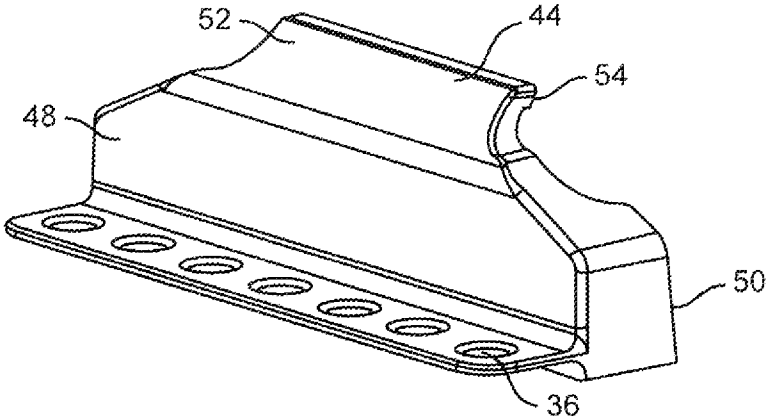

As shown more clearly in FIGS. 3A, 3B, insulator 44 is formed with a generally vertical body 50 and a wing 52. The wing 52 is formed so that it leans or extends away from wall 48. Wing 52 terminates with a horizontal profiled edge 54.

Insulator 44 is also formed with an outer vertical wall 56 disposed below and inwardly of profiled edge 54.

Figure 5:
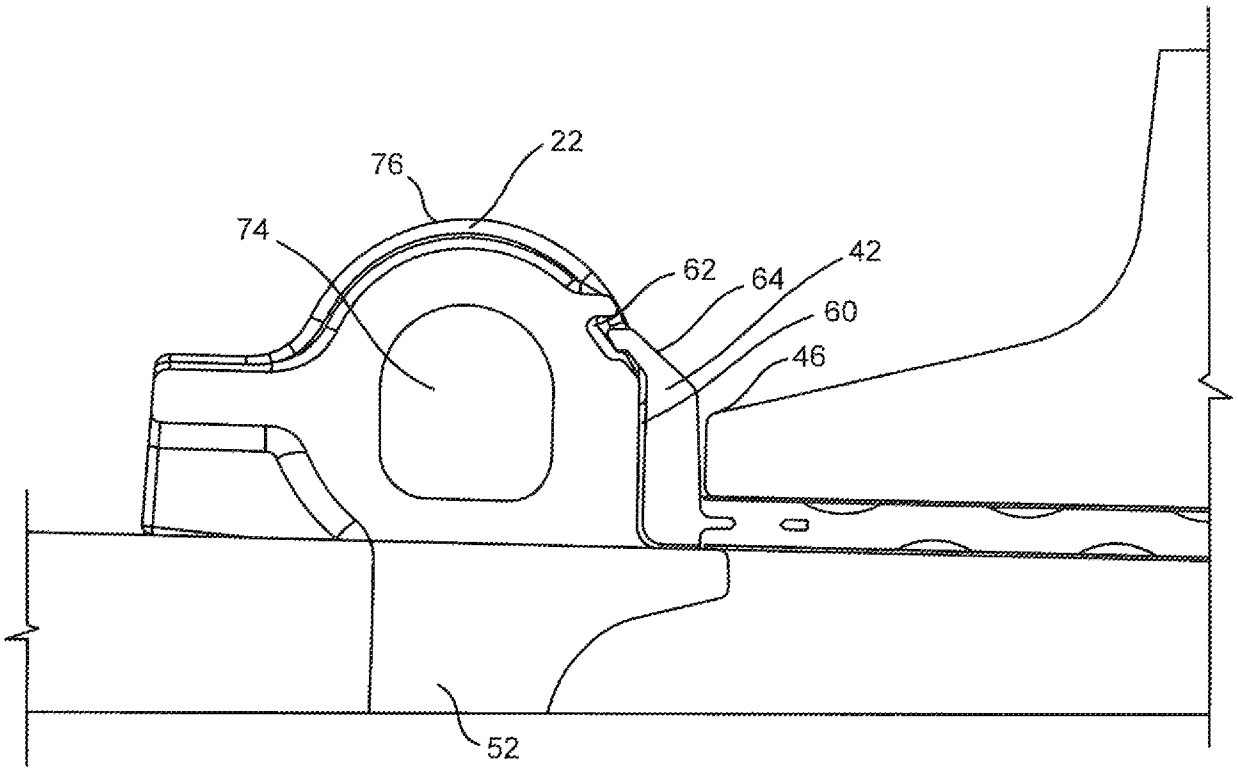
FIG. 5 shows an enlarged partial side view of the shoulder, plate and track used in FIG. 1.
Figure 5A:
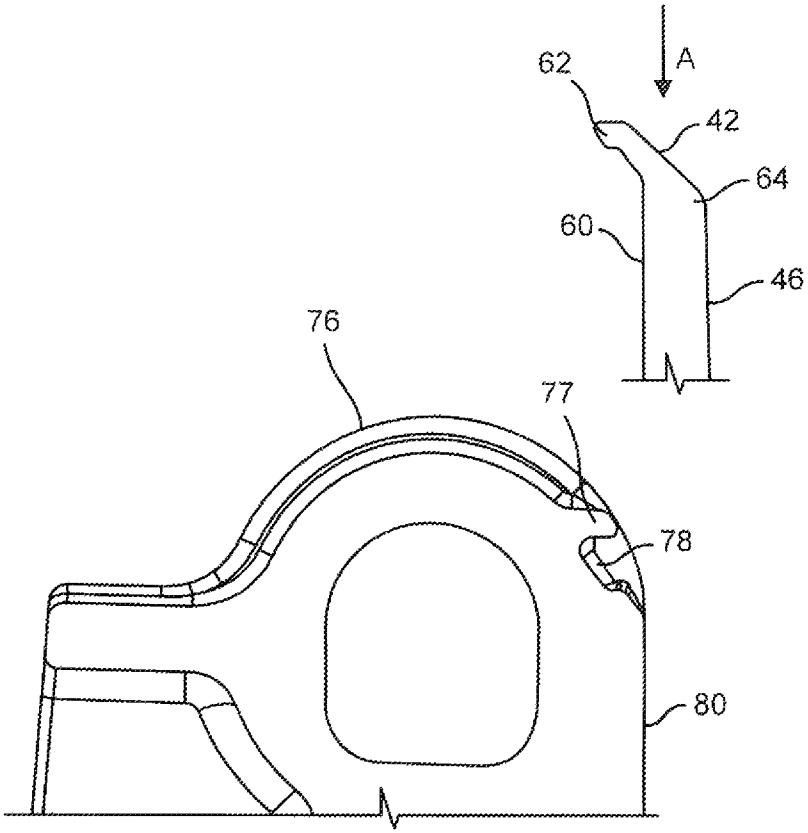
FIG. 5A shows how the plate engages the shoulder.

Insulator 42 similarly has an inner vertical wall 46 (discussed above), an outer vertical wall 60 and a horizontal edge 62 disposed on a wing 64 (see FIGS. 5, 5A).

Figure 4:
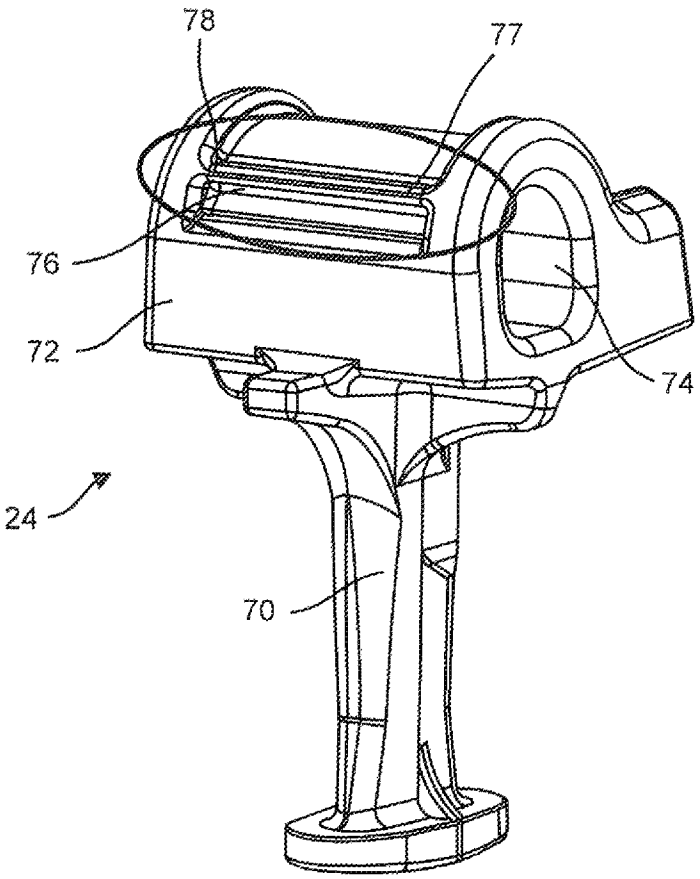
FIG. 4 shows an elevational view of the shoulder used in FIG. 1.

Referring to FIG. 4, shoulder 24 is formed with a leg 70 extending downwardly as shown. The leg 70 is connected to and is integral with a body 72. Body 72 is formed with a round horizontal bore 74. The body 72 further includes an external surface 76 formed with a lip 77 and an external horizontal groove 78 disposed below lip 77. Below grove 78 there is a vertical wall 80. Grove 78 is sized and shaped so that it is complementary to edge 62. Shoulder 22 has the same shape as shoulder 24.

The fastener assembly 18 is produced as follows. First, the concrete tie 16 is formed in a conventional manner. As part of this step, the shoulders 22, 24 are imbedded in the tie so that their legs 70 are completely disposed within concrete and only the bodies 72 are exposed, as shown in FIGS. 1 and 5. It should be noted that two sets of shoulders are used, on a tie, one for each rail.

The pad 20 with insulators 44, 46 are created independently of the tie 16. As discussed above, the pad 20 are either formed simultaneously with the insulators 42, 44, or separately. If the second technique is used, then the insulators 42, 44 are then attached to the pad 20 along sides 38, 40.

Note that the various components described above are sized and shaped so that when the pad 20 with its insulators 42, 44 are assembled the distance between the outer vertical walls 56, 66 are the same or just slightly less than the distance between the inner vertical walls 80 of the shoulders 22, 24. However the wings 52, 64 with their edges 54, 62 extend outwardly of these vertical walls. As a result, if the pad 20 with the insulators 42, 44 is placed above of the shoulders, edges 54, 62 rest on top of lips 77, as seen in FIG. 5A.

In order to attach the pad 20 and insulators 22, 24 (forming a pad assembly 90) to the tie 16, the pad 20 is dropped from about 0.25-0.5 inches As the pad assembly is falling, as indicated by arrow A in FIG. 5A, the bottom surfaces of the edges 54, 62 come into contact with the lips 77. The insulators 42, 44, or at least their wings are sufficiently elastic so the wings 52, 64 flex slightly inward until they clear the lips 77, and the edges 65, 62 then snap into grooves 78. In this manner, the pad assembly 90 is secured or captured between the shoulders 22, 24, as shown in FIGS. 1 and 5, but of course, without the rails 12. The pad assembly and the shoulders are thus held together by an interference fit between the wing edges of the insulators and the grooves of the shoulders. If necessary, the pad assembly can be separated from the shoulders by bending one or both wings inwardly and then placing a sharp object between the pad 20 and the tie 16 and forcing the pad 20 upward until the insulators disengage from the grooves in the shoulders.

The tie with the shoulders 22, 24 and the pad assembly 90 is now ready to be stored or shipped out to the field. The ties with the pad assembly and the shoulders are placed in position, the rails 12 are placed on the ties, as shown in FIG. 1, and conventional clips (not shown) are inserted into the holes 74 to fasten the rails down.

In an alternate embodiment, the shoulders are made with profiled edges to fit into matching groves in the insulators.

Obviously, numerous modifications may be made to this invention without departing from its scope as defined in the appended claims.

We claim:

1. A railroad fastening apparatus, comprising:

a first shoulder and a second shoulder that each include a main body with an aperture for receiving a rail fastening clip, a shoulder vertical wall with a horizontal groove, and a tie attachment member for attaching the shoulder to a tie; and a pad assembly including a pad body and first insulator and a second insulator disposed in parallel along said pad body, each of said first insulator and said second insulator including an insulator vertical wall and a wing terminating said insulator vertical wall and extending away from said pad body;

wherein said first shoulder and said second shoulder are spaced at a predetermined distance from each other to accommodate said pad assembly therebetween, with said wing of each of said first insulator and said second insulator extending into said horizontal groove of each of said first shoulder and said second shoulder to secure said pad assembly to said first shoulder and said second shoulder.

2. The apparatus of claim 1, wherein said first shoulder and said second shoulder are each attached to a tie.

3. The apparatus of claim 1, wherein said first insulator and said second insulator and said first shoulder and said second shoulder are configured to form interference fits therebetween.

4. The apparatus of claim 1, wherein said wing of each of said first insulator and said second insulator is flexible and is formed with an edge sized and shaped to fit into the groove of a respective shoulder, said wing of each of said first insulator and said second insulator bending inwardly as said pad assembly is inserted between said first shoulder and said second to fit into the respective groove.

5. The apparatus of claim 1, wherein each of said first insulator and said second insulator includes a horizontal lip formed on said shoulder with the respective groove being disposed under said horizontal lip.

6. The apparatus of claim 1, wherein said first insulator and said second insulator are attached to said pad body.

7. The apparatus of claim 1, wherein said first insulator and said second insulator and said pad body are made as a single unitary component.

8. An apparatus for supporting rails, comprising:

a tie arranged and constructed to support one or more railroad rails, said tie being made of a concrete material;

a pair of shoulders, each shoulder including a leg imbedded in said tie and a shoulder body including a bore for receiving a railroad fastening clip and an outer surface, each shoulder having a shoulder vertical wall formed with a horizontal groove; and a pad assembly including a pad body with lateral sides and two insulators disposed along said lateral sides, each said insulators including an insulator body with an insulator vertical wall disposed adjacent to a respective shoulder vertical wall and a wing disposed on said insulator vertical wall and extending away from said pad body and into the horizontal groove of the respective shoulder;

wherein said pad assembly is prevented from separating from said shoulders by the interference fits between the wings and the respective grooves.

9. The apparatus of claim 8, wherein said wings terminate in edges, said edges being disposed in said grooves with said grooves and the respective wings having complementary shapes.

10. The apparatus of claim 8, wherein said shoulders include a horizontal lip disposed above said groove.

11. The apparatus of claim 8, wherein said insulators are disposed at a distance selected to accept a rail therebetween.

12. An apparatus for supporting rails, comprising:

a tie arranged and constructed to support one or more railroad rails, said tie being made of a concrete material;

a pair of shoulders, each shoulder including a leg imbedded in said tie and a shoulder body including a bore for receiving a railroad fastening clip and an outer surface; and a pad assembly including a pad body with lateral sides and two insulators disposed along said lateral sides, each said insulator including an insulator body with a wing terminating in an edge, wherein each said shoulder includes an insulator attachment member with a horizontal groove and horizontal lip disposed above said groove and said shoulders are configured to selectively attach to said wings by forming interference fits between said grooves and said edges.

* * * * *